US005174115A

United States Patent [19]

Jacobson et al.

[11] Patent Number: 5,174,115

[45] Date of Patent: Dec. 29, 1992

[54] ELECTRICALLY ACTUATED AND CONTROLLED AUXILIARY HYDRAULIC SYSTEM FOR SKID STEER LOADER

[75] Inventors: Scott B. Jacobson, Kindred; Kenneth A. Brandt, Wyndmere, both of N. Dak.

[73] Assignee: Clark Equipment Company, South Bend, Ind.

[21] Appl. No.: 769,113

[22] Filed: Sep. 30, 1991

[51] Int. Cl.[5] ..... F16D 31/02; B60K 26/00

[52] U.S. Cl. ..... 60/484; 60/494; 180/324; 180/331; 180/333

[58] Field of Search ..... 60/484, 494; 180/53.4, 180/324, 331, 332, 333

[56] References Cited

U.S. PATENT DOCUMENTS

| | | | |
|---|---|---|---|
| 3,793,831 | 2/1974 | Khatti | 60/484 X |
| 3,842,602 | 10/1974 | Ziegler et al. | 60/484 X |
| 3,894,606 | 7/1975 | Hunck et al. | 60/484 X |
| 3,916,767 | 11/1975 | Barton | 60/484 X |
| 4,168,757 | 9/1979 | Mather et al. | 60/484 X |
| 4,210,061 | 7/1980 | Bianchetta | 60/484 X |
| 4,986,075 | 1/1991 | Shimoie | 60/484 X |

*Primary Examiner*—Edward K. Look

*Assistant Examiner*—John Ryznic

*Attorney, Agent, or Firm*—Kinney & Lange

[57] ABSTRACT

The present invention relates to an electrically actuated and controlled auxiliary hydraulic system for controlling the flow of hydraulic fluid under pressure to mounted attachments on a skid steer loader. In one embodiment, an electrically actuated auxiliary control valve is coupled to the front and rear mounted attachments through an electrically actuated diverter valve. In a second embodiment, a front and a rear auxiliary control valve is coupled to the front and rear mounted attachments. An operator can select between control of either the front or rear attachments by selectively actuating the forward, reverse and latch switches on the control handles. A mode control switch electrically coupled to an auxiliary mode control circuit allows the cyclical selection between the disable mode, the momentary mode, and the latch mode. In the disable mode, the actuation of the forward, reverse or latch switches has no effect. In the momentary mode, the operator controls the particular attachment during the time of the switch actuation. In the latch mode, the front attachment can be operated in a high pressure mode allowing extra power to be delivered to the front attachment.

24 Claims, 6 Drawing Sheets

ELECTRICALLY ACTUATED AND CONTROLLED AUXILIARY HYDRAULIC SYSTEM FOR SKID STEER LOADER

BACKGROUND OF THE INVENTION

The present invention relates generally to auxiliary hydraulic systems for skid steer loaders. In particular, the present invention is an electrically actuated and controlled auxiliary hydraulic system with cyclical operating mode selection.

Skid steer loaders are compact, highly maneuverable vehicles which are maneuvered by an operator seated within an operator compartment by actuating a pair of steering levers. The extent to which each lever is pushed in a particular direction controls the speed at which the wheels on that side of the vehicle will rotate. Similarly, the extent to which the lever is pulled in a reverse direction will control the speed at which the wheels on that side of the vehicle are rotated in a reverse direction.

Attachments such as an auger, a grapple, sweeper, landscape rake, snowblower or backhoe which include their own hydraulic motor are sometimes mounted to a boom assembly on the front of the skid steer loader. An auxiliary hydraulic system is used to control the flow of hydraulic fluid between the skid steer loader auxiliary hydraulic pump and the hydraulic motor on the front mounted attachment. Attachments such as scarfers or stabilizers which also include hydraulic motors are sometimes mounted to the rear of the loader. These rear mounted attachments are also supplied with hydraulic fluid from the auxiliary hydraulic pump by an auxiliary hydraulic system.

Electrically controlled auxiliary hydraulic systems have been used in conjunction with skid steer loaders. In one skid steer loader, the electrically controlled auxiliary hydraulic system includes electromechanic devices, including relays, to perform logic and switching operations. Electromechanical relays include a spring which holds an armature in a normal position and a coil which, when energized, positions the armature to make contact with a particular contactor. However, electromechanical relays are susceptible to mechanical shock and vibration, and are adversely affected by the rugged environment in which the skid steer loader normally operates. Therefore, a skid steer loader with an improved electrically controlled auxiliary hydraulic system is desired.

SUMMARY OF THE INVENTION

A skid steer loader in accordance with a first embodiment of the present invention includes an operator compartment, an engine and a hydraulic pump driven by the engine to provide hydraulic fluid under pressure. The loader has an attachment means for mounting an attachment having an auxiliary hydraulic motor. Fluid fittings couple hydraulic fluid to the hydraulic motor of the mounted attachment. An electrically actuated main control valve controls hydraulic fluid flow between the hydraulic pump and the auxiliary fluid fittings.

The auxiliary control valve responds to signals from the electric auxiliary control system. A momentary auxiliary control switch system coupled to the auxiliary control valve causes momentary hydraulic fluid flow in a first direction during actuation of a momentary switch by the operator. A latching auxiliary control switch system coupled to the electrically actuated auxiliary control valve causes continuous fluid flow in a forward direction in response to the operator actuation of a latch switch. The auxiliary control valve is also coupled to an auxiliary mode control circuit.

The auxiliary mode control circuit operates in three modes, namely, disable, momentary and latch modes. The disable mode disables the control of the momentary switch system and latching switch system over the auxiliary control valve. The momentary mode permits the momentary switch to control operation of the main control valve and disables the latch switch from controlling the main control valve. The latch mode enables latch switch control over the auxiliary control valve. An auxiliary control mode display coupled to the mode control circuit provides a visual indication of the selected mode of operation.

Another embodiment of a skid steer loader in accordance with the present invention couples an electrically actuated diverter valve to the auxiliary mode control circuit. The diverter valve is coupled in the hydraulic circuit between the auxiliary control valve and the front fluid fittings, and between the auxiliary control valve and the rear fluid fittings. The diverter valve selects the routing of hydraulic fluid between the auxiliary control valve and the front and rear auxiliary fluid fittings in response to an electrical signal from the auxiliary mode control circuit. A rear momentary auxiliary control switch system coupled to the auxiliary control valve causes hydraulic fluid flow to the rear auxiliary fluid fittings when actuated by the operator.

Another embodiment of a skid steer loader in accordance with the present invention includes a second electrically actuated auxiliary control valve coupled in a hydraulic circuit between the hydraulic pump and the rear auxiliary fluid fittings for controlling hydraulic fluid flow in response to electric auxiliary control signals. A rear momentary auxiliary control switch system is coupled to the second electrically actuated auxiliary control valve for causing hydraulic fluid flow to the rear auxiliary fluid fittings when actuated by the operator.

If desired, an electrically actuated pressure relief assembly coupled in the hydraulic circuit may be used for increasing the relief pressure of the hydraulic fluid circuit when particular circuits are being used. The pressure relief assembly operates at a first relief pressure except when the auxiliary mode control circuit is in the latch mode, or in the momentary mode while actuating the front auxiliary momentary forward switch, when the relief pressure is raised for operation of the forward attachment motors.

DETAILED DESCRIPTION OF THE PREFERRED EMBODIMENTS

Figure 1:
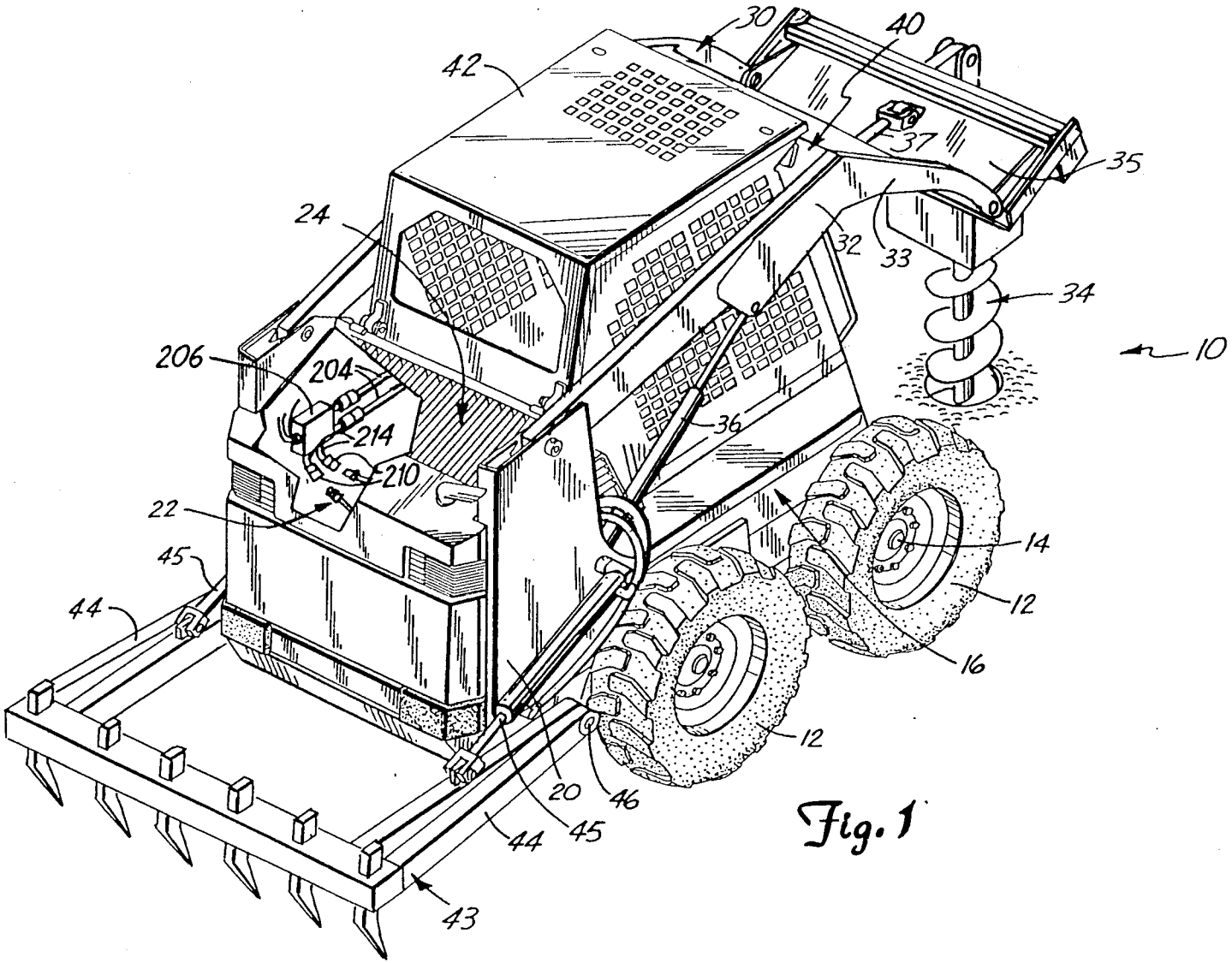
FIG. 1 is a perspective view taken from the right rear side of a skid steer loader which includes an electrically controlled auxiliary hydraulic system in accordance with the present invention.
Figure 2:
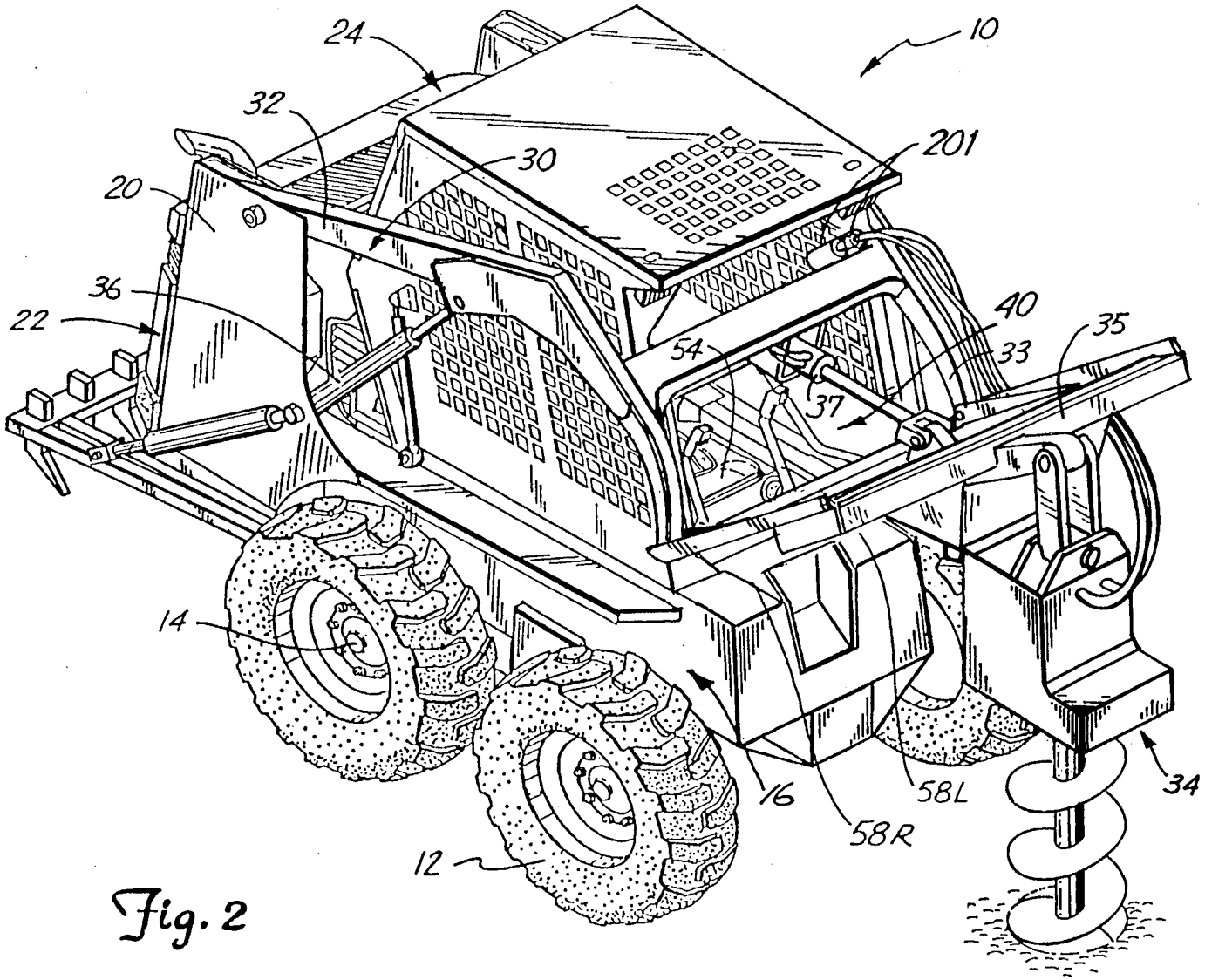
FIG. 2 is an illustration of the loader shown in FIG. 1 taken from the right front side.

A skid steer loader 10 which includes an electrically actuated and controlled auxiliary hydraulic system in accordance with the present invention is illustrated generally in FIGS. 1 and 2. Loader 10 includes a main frame assembly 16 mounted to a lower frame assembly or transmission case (not shown), lift arm assembly 30 and operator's compartment 40. An engine compartment 22 and heat exchanger compartment 24 are located at the rear of the vehicle. Wheels 12 are mounted to stub axles 14 and extend from both sides of main frame 16.

Lift arm assembly 30 is mounted to upright members 20 which are located at the rear of main frame assembly 16. As shown, lift arm assembly 30 includes an upper portion formed by a pair of lift arms 32, and a lower portion 33. A front attachment mount 35 is pivotally mounted to lower portion 33. Front mounted attachments such as auger 34 are mounted to lift arm assembly 30 by means of mount 35. Lift arm assembly 30 is raised and lowered with respect to main frame assembly 16 by a pair of lift cylinders 36. Attachment mount 35, and therefore auger 34, are rotated with respect to lift arms 32 by tilt cylinder 37.

Rear mounted attachments such as scarifier 43 can also be carried by loader 10. Rear scarifier 43 includes a pair of rearwardly extending members 44 which are rotatably mounted to upright members 20 by means of rear pivot mounts 46 (only one is visible in FIG. 1). Double-acting rear hydraulic cylinders 45 (i.e. a linear hydraulic motor) raise and lower scarifier 43 with respect to loader 10.

Operator's compartment 40 is partially enclosed by cab 42. Cab 42 is an integral unit which is pivotally mounted at its rear to main frame 16. Cab 42, including the operator seat 54, can thereby be rotated upwardly and toward the rear of loader 10 to permit access to engine compartment 22, the transmission case, and other mechanical and hydraulic systems described herein.

All operations of loader 10 can be controlled by an operator from within operator compartment 40. The hydraulic drive system of loader 10 includes a pair of steering levers 58L and 58R which are pivotally mounted on the left and right sides, respectively, of seat 54. Levers 58L and 58R can be independently moved in forward and rearward directions, and are biased to a central or neutral position. Actuation of levers 58L and 58R causes wheels 12 on the respective side of loader 10 to rotate at a speed and in a direction corresponding to the extent and direction of lever motion. Lift cylinders 36 and tilt cylinder 37 are independently actuated through movement of separate foot pedals (not visible) mounted toward the front of operator compartment 40. The general operation of skid steer loaders such as 10 is well known.

Figure 3A:
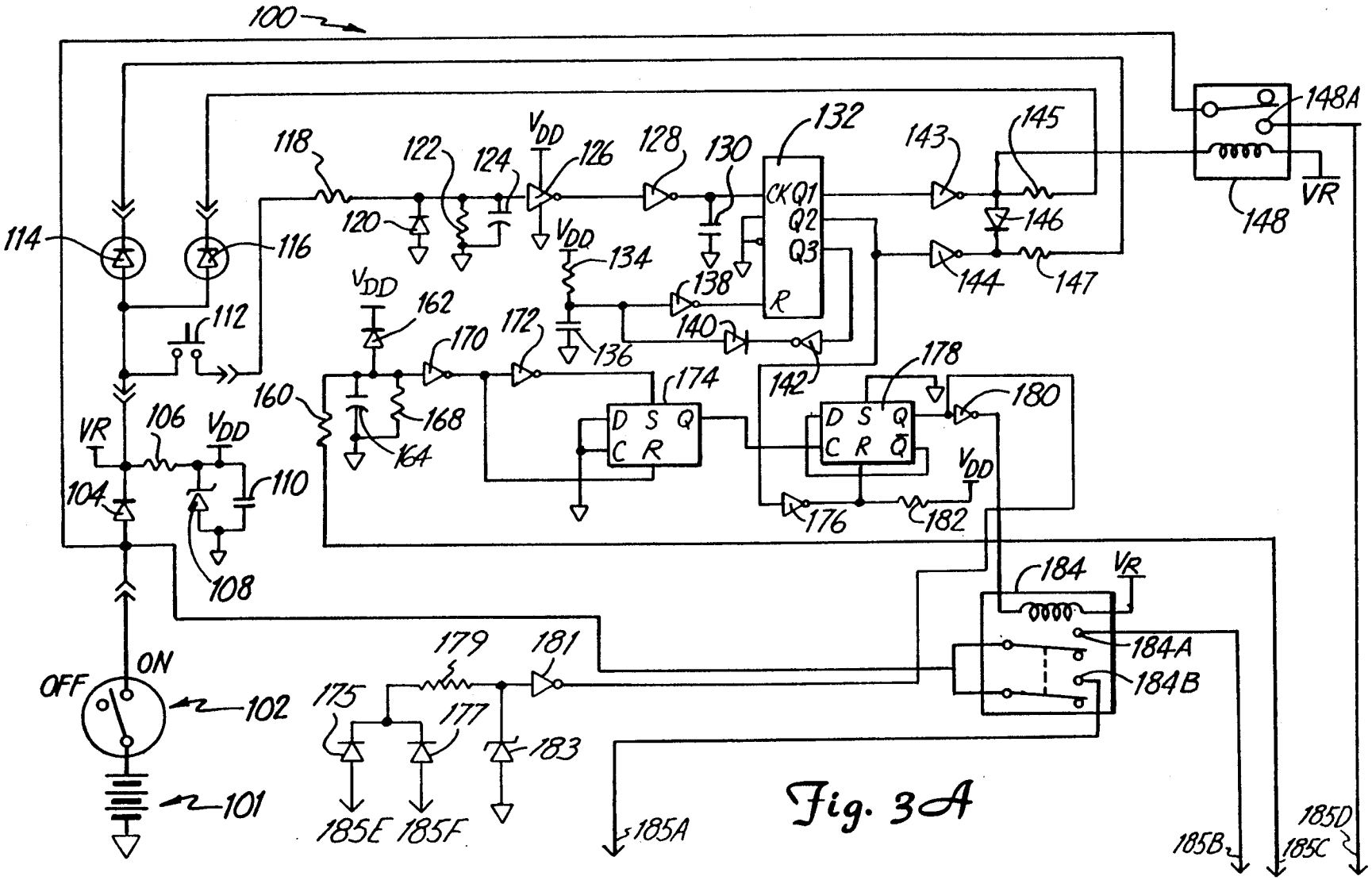
FIG. 3A is a schematic diagram of the auxiliary mode control circuit.
Figure 3B:
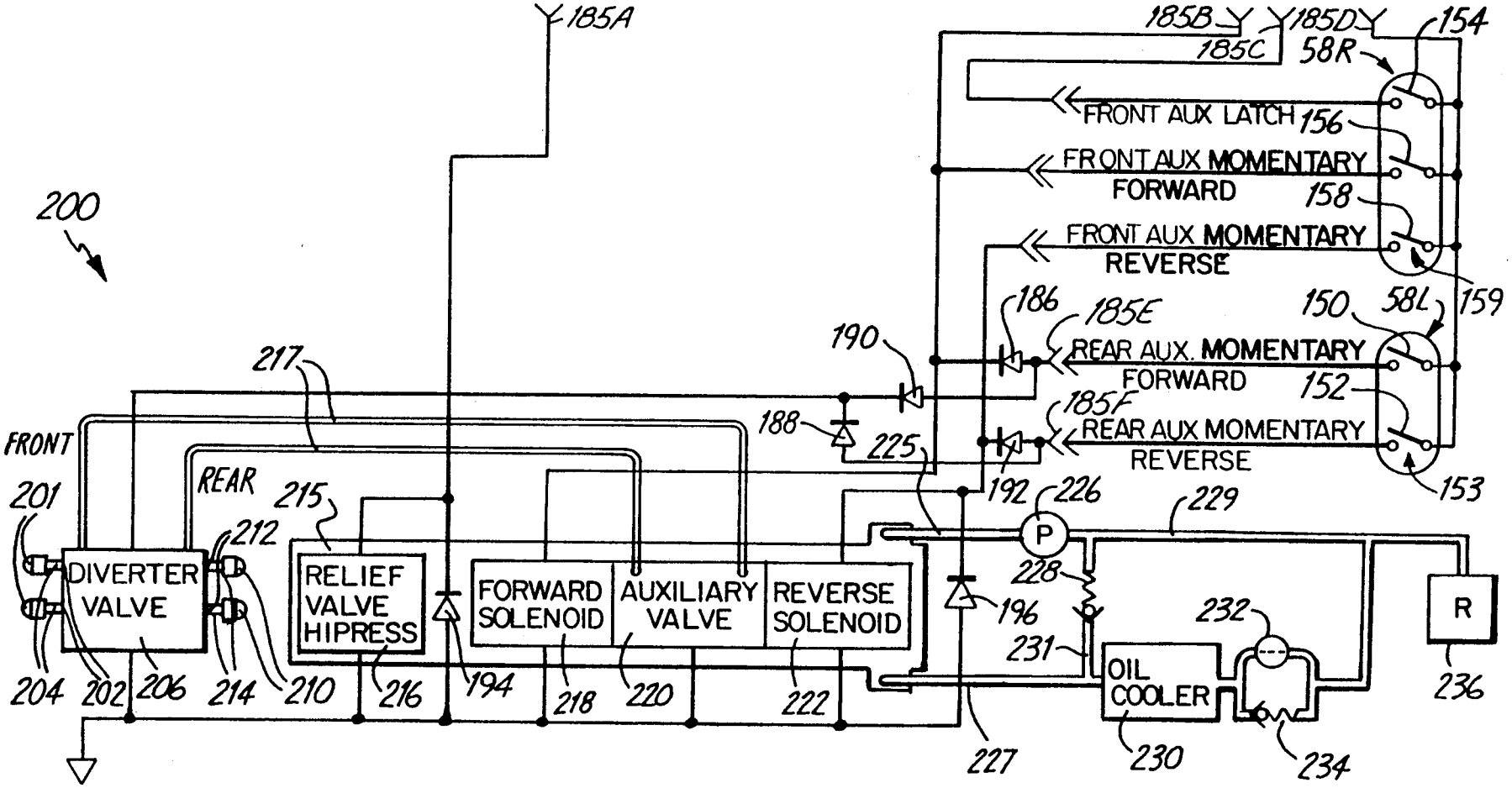
FIG. 3B is a block diagram of an electrically actuated auxiliary hydraulic system.

An auxiliary hydraulic system 200 for skid steer loader 10, and its interconnections to auxiliary mode control circuit 100, are illustrated in FIGS. 3A and 3B. As shown in FIG. 3B, hydraulic system 200 includes a fluid reservoir 236, hydraulic pump assembly 226, hydraulic fluid or oil cooler 230, valve block 215 and electric diverter valve 206. Pump assembly 226 is mounted within engine compartment 22 (FIG. 1 and driven by the engine (not shown). Valve block 215 includes an auxiliary valve 220.

Auxiliary valve 220 is a spring centered electrically actuated valve mechanically coupled to forward actuation solenoid 218 and reverse actuation solenoid 222. As shown, the fluid outlet ports of auxiliary valve 220 are coupled to inlet ports of diverter valve 206 through hydraulic hoses 217. Solenoids 218 and 222 are connected to receive electric auxiliary select signals from auxiliary mode control circuit 100, and switch assemblies 153 and 159. When actuated, forward solenoid 218 drives the spool (not separately shown) of auxiliary valve 220 in a first direction, causing hydraulic fluid to flow to diverter valve 206 in a first or forward direction through hoses 217. When reverse solenoid 222 is actuated, the spool is driven in a second direction, and causes hydraulic fluid flow to diverter valve 206 in a second or reverse direction. When neither of the solenoids 218 or 222 are energized, the valve is returned to a neutral position. The other valves used also are moved to a neutral position where flow is returned to drain when the valve is not engaged.

Electrically controlled relief valve 216 is connected in a hydraulic circuit with the auxiliary valve 220. Relief valve 216 is also coupled to auxiliary mode control circuit 100. In response to electric pressure control signals provided by auxiliary mode control circuit 100, relief valve 216 selectably controls the relief pressure of hydraulic system 200. Whenever the pressure within system 200 exceeds the relief setting of valve 216, the valve will shunt fluid to reservoir 236. Pump assembly 226 is coupled to reservoir 236 by hydraulic hose 229. Pressurized hydraulic fluid from an outlet of pump assembly 226 is supplied to an inlet port of valve block 215 through hose 225. An outlet port of valve block 215 is coupled to oil cooler 230 through hose 227, and to reservoir 236 (via hose 229) through hose 231 and excess oil bypass relief valve 228. After being cooled by oil cooler 230, hydraulic fluid from valve block 215 is coupled to an inlet port of pump assembly 226 through a parallel combination of filter 232 and relief valve 234.

As shown in FIG. 1, electrically controlled diverter valve 206 can be mounted within engine compartment 22, on left upright member 20. In FIG. 3B, front auxiliary ports 202 of diverter valve 206 are coupled to front mounted attachment hydraulic fittings 201 by hydraulic hoses 204. As shown in FIG. 2, front mounted attachment fittings (quick couplers) 201 can be mounted to lower portion 33 of lift arm assembly 30, near attachment mount 35. The hydraulic motor of front mounted attachments such as auger 34 can then be conveniently connected to hydraulic system 200. As shown in FIG. 3B, rear auxiliary ports 212 of diverter valve 206 are coupled to rear mounted attachment hydraulic fittings 210 through hydraulic hoses 214. In the embodiment shown in FIG. 1, rear mounted attachment hydraulic fittings 210 (quick couplers) are mounted within engine compartment 22 near diverter valve 206. Hydraulic cylinders 45 of rear scarifier 43 can then be easily interconnected to hydraulic system 200.

Electric diverter valves, such as diverter valve 206 are well known and commercially available from a number of manufacturers. In response to electric auxiliary select signals from auxiliary mode control circuit 100, diverter valve 206 will selectively route hydraulic fluid received through its input ports to either output ports 202 or output ports 212. Auxiliary valve 220 can then be used to control either the front mounted attachment, such as auger 34, or the rear mounted attachment, such as rear scarifier 43.

A preferred embodiment of auxiliary mode control circuit 100 and its interconnections to auxiliary valve solenoids 218 and 222, relief valve 216 and diverter valve 206 of hydraulic system 200 are also illustrated in FIGS. 3A and 3B. An operator selectively actuates the auxiliary mode control circuit 100 through switch assemblies 153 and 159. Switch assemblies 153 and 159 are positioned on the top of the hand grips of steering levers 58L and 58R, respectively, for convenience of use. Switch assembly 153 includes a rear auxiliary momentary forward direction switch 150 and a rear auxiliary momentary reverse direction switch 152. Switch assembly 159 includes front auxiliary latch switch 154, front auxiliary momentary forward direction switch 156, and front auxiliary momentary reverse direction switch 158. Switches 150, 152, 154, 156 and 158 are biased by a spring or other means (not shown) to a normally open position.

Figure 4A:
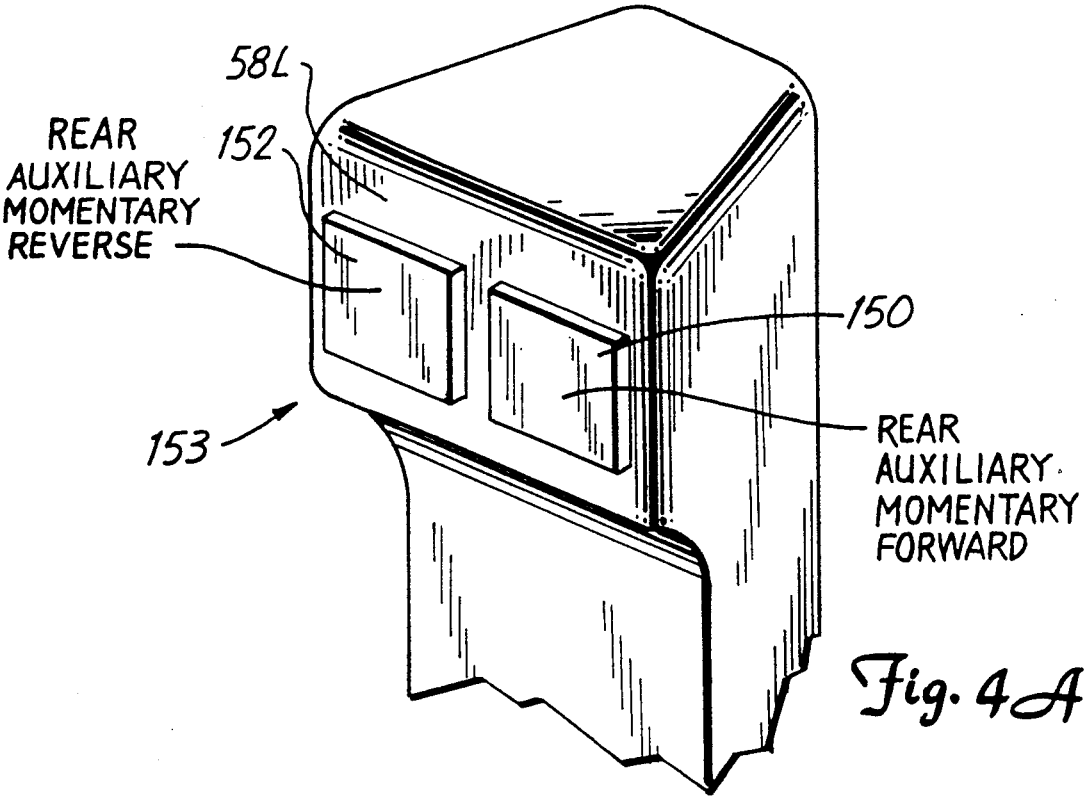
FIG. 4A is a detailed view of the top of the hand grip on the left steering lever shown in FIG. 2.
Figure 4B:
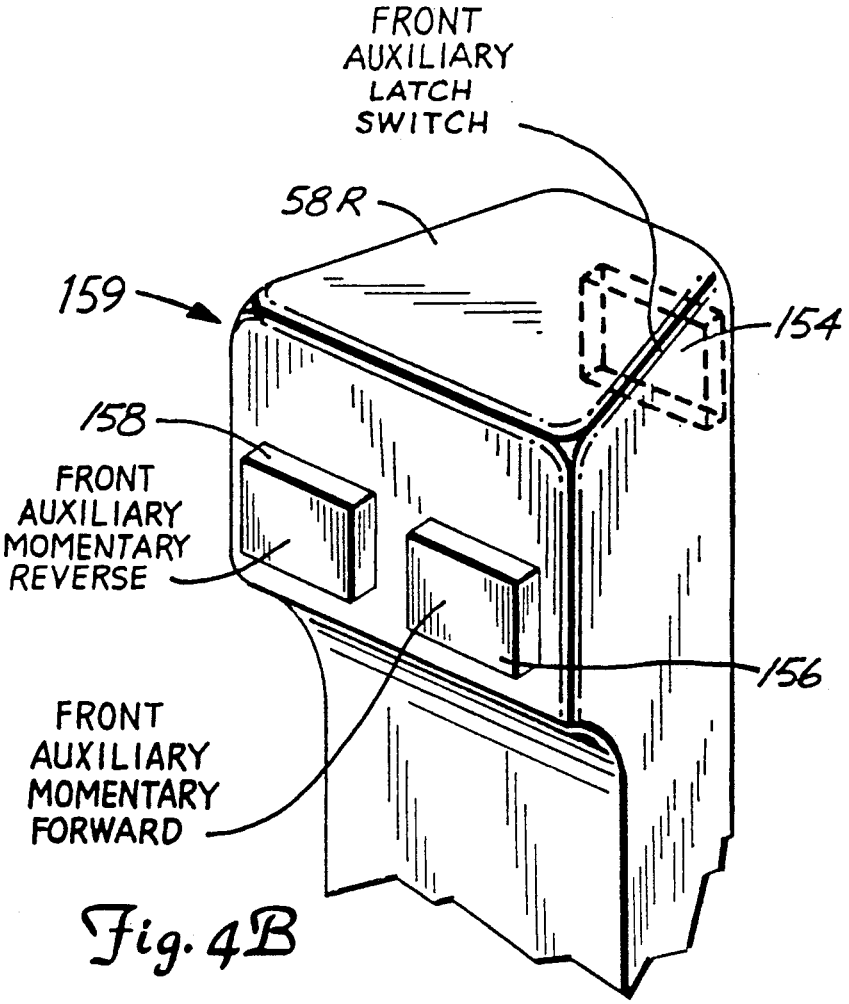
FIG. 4B is a detailed view of the top of the hand grip on the right steering lever shown in FIG. 2.

The front auxiliary momentary forward switch 156 is located on the right side of the right control handle 58R, on the side facing generally toward the operator (shown in FIG. 4B). When the circuit is on or enabled and the switch 156 is pressed, the electrically actuated auxiliary control valve 220 moves to cause hydraulic fluid flow to be directed to the front fittings 201 in a first (forward) direction. This fluid flow stops as soon as switch 156 is released.

The front auxiliary momentary reverse switch 158 is located on the left side of the right control handle 58R on the side facing generally toward the operator (shown in FIG. 4B). When the circuit is on or enabled and the switch 158 is pressed, the electrically actuated auxiliary control valve 220 moves to cause hydraulic fluid flow to be directed to the front fittings 201 in a second (reverse) direction. This action is stopped when the switch 158 is released. "Momentary operation" means the valve is on only so long as the respective control switch is depressed.

The front auxiliary latch switch 154 is located on the right control handle 58R opposite the operator (shown in FIG. 4B). When operating in the latch mode, the first actuation of latch switch 154 by the operator will cause continuous fluid flow in the first or forward direction to the front auxiliary fluid fittings 201. A subsequent press discontinues such continuous fluid flow to the fittings. The latch switch actuation also energizes the high pressure relief valve so that continuous fluid flow in forward direction to the front fittings 201 is provided at a higher relief pressure than normal. The higher relief pressure also can be provided by actuation of the front auxiliary momentary forward switch.

The rear auxiliary momentary forward direction switch 150 is located on the left control handle 58L on a side generally facing the operator (shown in FIG. 4A). The switch 150 controls the diverter valve and when switch 150 is depressed, the diverter valve directs fluid to the rear auxiliary fittings 210 through the auxiliary valve 220 which is energized to direct fluid flow to the rear auxiliary fittings 210 in a first (forward) direction. The fluid flow stops when switch 150 is released.

The rear auxiliary momentary reverse switch 152 is located on the left control handle 58L generally facing the operator and to the left of switch 150 (shown in FIG. 4A). When switch 152 is depressed, diverter valve 206 again directs fluid flow to the rear fluid fittings 210 through the auxiliary valve 220 which also is energized to direct fluid flow to the rear auxiliary fittings 210 in a second (reverse) direction. The fluid flow through valves 206 and 220 stops when the switch 152 is released.

Rear auxiliary forward direction switch 150 and rear auxiliary reverse direction switch 152 are capable of momentarily overriding the latch function initiated by actuating forward auxiliary latch switch 154 while in the latch mode. Actuation of rear auxiliary forward direction switch 150 or rear auxiliary reverse direction switch 152 while in the latch mode temporarily discontinues the continuous fluid flow to the front auxiliary fluid fittings 201, and allows the operator to raise or lower a rear attachment without having to shut off the latch function with a subsequent actuation of latch switch 154. Releasing the actuated rear auxiliary direction switch 150 or 152 automatically allows the resumption of the latching function.

In FIG. 3A and continuing on FIG. 3B, auxiliary mode control circuit 100 shown in detail includes battery 101; enable switch 102; mode select switch 112; auxiliary mode control display LEDs 114 and 116; normally open electromechanical relays 148 and 184; diodes 104, 108, 120, 140, 146, 162, 175, 177, 183, 186, 188, 190, 192, 194, and 196; resistors 106, 118, 122, 134, 145, 147, 160, 168, 179 and 182; Capacitors 110, 124, 130, 136, and 164; inverters 126, 128, 138, 142, 143, 144, 170, 172, 176, 180, and 181; counter 132; and D flip-flops 174 and 178.

Battery 101 is connected in a negative ground configuration and the positive terminal is connected to enable the switch 102 which is the main key operated switch for the skid steer loader. When enable switch 102 is switched to an ON position which occurs when the loader engine is started, voltage reference (VR) is provided on a cathode side of diode 104. VR is coupled to relay coils which control relays 148 and 184. A voltage regulated power supply (VDD) configuration includes resistor 106, zener diode 108 and capacitor 110. VDD is provided as needed to power electronic components within the auxiliary mode control circuit 100.

When switch 102 is in the OFF position, the auxiliary mode control circuit is disabled. During this disabled state, actuation of any of the auxiliary switches in switch assemblies 153 and 159 on control handle 58L and 58R will have no effect. LEDs 114 and 116 are off during this period of time.

When switch 102 is placed in the ON position, LEDs 114 and 116 will not be illuminated and power is not applied to the auxiliary switches 153 and 159. To reiterate, sequential actuation of mode control switch 112 cycles the mode select circuitry through three states, namely, disabled, momentary and latch modes.

In the first state, the disabled mode, actuation of any of the auxiliary switches of switch assemblies 153 and 159 will have no effect. LEDS 114 and 116 are off during this mode. The first press of mode select switch 112 after key switch 102 is turned on places the mode select circuity in its second or momentary mode state.

During the momentary mode state of the mode select circuitry, all the front and rear momentary functions are enabled, but the "latch" function remains disabled. LED 116 is illuminated and LED 114 is off to indicate the selection of the momentary mode. A subsequent press of mode select switch 112 places the circuitry in its third, latch mode, state.

In the latch mode, the auxiliary latch function is enabled, and the front momentary functions are still enabled. LED 114 and LED 116 are both illuminated during the latch mode. The next press of mode select switch 112 cycles the circuitry back to the disable mode, and the circuitry cycles to the next mode in the cycle on each subsequent press of mode select switch 112.

Reset circuitry is coupled with the reset (R) terminal of counter 132. When switch 102 is first placed in the ON position, power from the VDD supply will be applied to the series resistor 134 and capacitor 136 arrangement of the reset circuitry. As capacitor 136 charges, the output of the inverter 138, which is applied to the reset terminal counter, will switch from a logic 1, or logic high, to a logic 0, or a logic low. This resets the Q1–Q3 counter output terminals to a logic 0 or low, the disable mode. Output terminals Q1, Q2 and Q3 of counter 132 determine the mode of operation. Inverters 143 and 144 coupled to counter 132 outputs Q1 and Q2, respectively, will provide a logic 1 or high signal at their output, preventing LEDs 114 and 116 from being illuminated. A logic 1 signal at the output of inverters 143 and 144 prohibit current flow through the coil of normally open relay 148. Therefore, no power is supplied to the inputs of the latch and momentary switches of switch assemblies 153 and 159. Actuation of any of these switches at this time causes no response from the auxiliary solenoids 218 and 222 or valves 206, 216, and 220.

The first press of mode select switch 112, thus selecting the momentary mode, couples a pulse to a clock (CK) input terminal of counter 132 through switch debounce circuitry and inverters 126 and 128. The Q1 output of counter 132 changes to a logic 1, while Q2 and Q3 outputs remain at a logic 0. The logic 1 output at the Q1 terminal of counter 132 results in a logic 0 at the output of inverter 143 to which it is coupled. Current flows through LED 116 and the coil of relay 148. The relay 148 armature is therefore switched to contact 148A, coupling the battery to the inputs of the latch and momentary switches of switch assemblies 153 and 159. Actuation of one of the front momentary switches 156 and 158 therefore causes power to be directly coupled to either one of forward or reverse solenoids 218 and 222, respectively, of auxiliary valve 220. Actuation of one of the rear momentary switches 150 and 152 causes the associated forward or reverse solenoids 218 or 222, respectively, and diverter valve 206 to be energized, directing fluid flow to rear fluid fittings 210.

In the momentary mode, however, counter output Q2 is still a logic 0, and is applied to inverter 176. A logic 1 is therefore applied to the reset terminal of latch enable flip-flop 178, resulting in a logic 0 at output Q of flip-flop 178. The Q output terminal of flip-flop 178 is coupled to inverter 180, causing the output of inverter 180 to be a logic 1, thereby preventing the flow of current through the coil of normally open relay 184 because the coil is not grounded. Since contacts 184A and 184B of relay 184 are open, no power can be supplied to either forward solenoid 218 or relief valve 216 through relay 184.

The next press of the mode select button 112, thus selecting the latch mode, clocks counter 132 so that counter output Q1 is a logic 0, Q2 is a logic 1, and Q3 is a logic 0. The output of inverter 144 coupled to the Q2 output is therefore a logic 0, enabling current flow through and illuminating of LED 114. Diode 146 coupled between inverters 143 and 144 also enables current flow through LED 116 and through the coil of relay 148 so that the armature of relay 148 remains switched to contact 148A of relay 148, thus providing power to switch assemblies 153 and 159.

The Q2 output of counter 132 is logic 1 in this state (latch mode) and is coupled to inverter 176, resulting in a logic 0 being applied to the reset input of latch enable flip-flop 178, thus enabling flip-flop 178. At the same time, Q output of flip-flop 178 remains a logic 0, resulting in a logic 1 at the output of inverter 180, therefore preventing current flow through the coil of relay 184. However, latch enable flip-flop 178 is now enabled.

A press of the latch switch 154 applies a pulse to the latch control flip-flop 174 through debounce circuitry. This pulse causes the Q output of latch control flip-flop 174 to clock the C input of the latch enable flip-flop 178. Output Q of latch enable flip-flop 178 changes to a logic 1, resulting in a logic 0 at the output of inverter 180. Current therefore flows through the coil of the latch relay 184 to switch the armature to contacts 184A and 184B. Forward solenoid 218 is powered causing continuous fluid flow. Power is also applied to relief valve 216 to cause the relief pressure to be at the higher pressure so a higher operating pressure is available.

Actuation of either the rear auxiliary forward direction switch 150 or the rear auxiliary reverse direction switch 152 during the continuous fluid flow provided during the latching function produces a logic 1 at 185E or 185F which results in a logic 1 being applied to the electrically coupled input of inverter 181 which in turn results in a logic 0 at the output of inverter 181. Inverter 181 is electrically coupled to the Q output of latch enable flip-flop 178 and the input of inverter 180. The logic 0 output of inverter 181 sinks the output logic 1 current of the Q output of latch enable flip-flop 178, resulting in a logic 0 at the input of inverter 180 which in turn results in a logic 1 at the output of inverter 180. The logic 1 output of inverter 181 therefore prevents current flow through the coil of relay 184. This results in the temporary discontinuation of the latching function during the actuation of rear auxiliary forward direction switch 150 or rear auxiliary reverse direction switch 152 without changing the output status of latch enable flip-flop 178. Thus, releasing the actuated rear auxiliary direction switch 150 or 152 results in a continuation of the latching function.

Another press of latch switch 154 results in a pulse which causes latch enable flip-flop 178 to change output states, thereby discontinuing the flow of current through the coil of latch relay 184, and thereby opening the circuit to discontinue the latching action. This operation of latch switch 154 can be repeated as long as counter 132 is in the latch mode.

The next press of mode select switch 112, thus selecting the disable mode, causes the Q2 output of counter 132 to go low. Q1 is also low. The Q3 output goes to a logic 1. As a result, power to the coil of relay 148 is shut off thereby disabling switch assemblies 153 and 159 and turning off LEDs 114 and 116. The Q3 output is coupled to the reset circuitry Which subsequently causes Q1 through Q3 outputs of counter 132 to be reset to logic 0.

Figure 5:
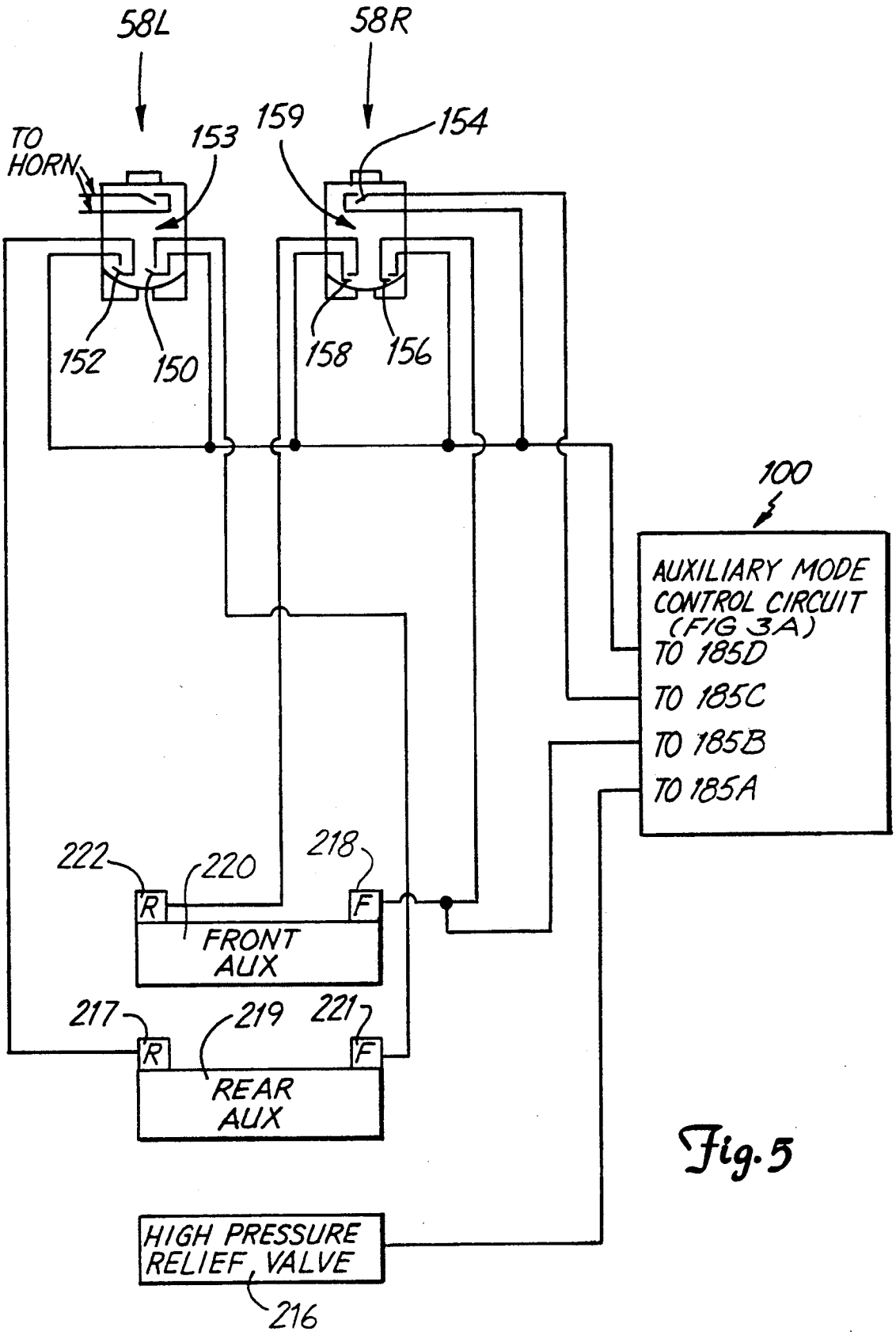
FIG. 5 is a block diagram representation of a second embodiment of an electrically actuated and controlled auxiliary hydraulic system.

FIG. 5 shows diagrammatically another preferred embodiment of the auxiliary mode control circuit 100 coupled to pressure relief valve 216 at 185A, front auxiliary valve 220 at 185B, and switch assemblies 153 and 159 at 185C and 185D.

In the momentary mode, power is supplied to switch assemblies 153 and 159. Actuation of rear auxiliary momentary forward direction switch 150, and resultant energization of solenoid 221 of the rear auxiliary valve 219, causes fluid flow through rear auxiliary valve 219 in a forward direction. Actuation of rear auxiliary momentary reverse direction switch 152, and resultant energization of reverse solenoid 217 of rear auxiliary valve 219, causes fluid flow through rear auxiliary valve 219 in a reverse direction. Actuation of front auxiliary momentary forward direction switch 156, and resultant energization of solenoid 218 of front auxiliary valve 220, causes fluid flow through front auxiliary valve 220 in a forward direction. Actuation of front auxiliary momentary reverse direction switch 158, and resultant energizing of reverse solenoid 222 of front auxiliary valve 220, causes fluid flow through the front auxiliary valve 220 in a reverse direction.

In the latch mode, forward solenoid 218 of front auxiliary valve 220 is coupled to the 184A contact of relay 184 (see also FIG. 3A). Actuation of latch switch 154 results in continuous fluid flow in a forward direction in the front auxiliary valve 220. Pressure relief valve 216, coupled to contact 184B of relay 184 (see also FIG. 3A), causes fluid flow in the front auxiliary valve 220 to be at a higher relief pressure.

In the disable mode, electrical power is disconnected from the switch assemblies 153 and 159, thereby prohibiting fluid flow in either the rear auxiliary valve 219 or front auxiliary valve 220.

The present invention provides an improved electrically controlled auxiliary hydraulic system for a skid steer loader. The system is simple to construct from available electromechanical and electronic components. A reduced number of electromechanical components results in improved performance of the electrically actuated and controlled auxiliary hydraulic system in environments which subject the system to substantial mechanical shock and vibration. Furthermore, the inclusion of digital logic circuitry provides the added flexibility of allowing the operator to select one of three operating modes: the disabled mode, the momentary mode, and the latch mode.

A single mode select button allows the operator to sequentially select the desired operating mode. Electrical control switch systems provide a convenient operator interface with the auxiliary hydraulic system.

Although the present invention has been described with reference to preferred embodiments, workers skilled in the art will recognize that changes may be made in form and detail without departing from the spirit and scope of the invention.

What is claimed is:

1. A skid steer loader adapted for use in conjunction with an attachment having a hydraulic motor, including:

an operator compartment;

an engine;

a hydraulic pump driven by the engine for providing hydraulic fluid under pressure;

a lift arm assembly;

a forward attachment mount for removably mounting said attachment having an auxiliary hydraulic motor to the lift arm assembly;

a first auxiliary fluid fitting for coupling the hydraulic fluid to the hydraulic motor of the attachment;

an electrically actuated auxiliary control valve coupled in a hydraulic circuit between the hydraulic pump and the first auxiliary fluid fitting for controlling hydraulic fluid flow in response to electric auxiliary control signals;

a momentary auxiliary control switch system including a forward momentary switch coupled to the electrically actuated auxiliary control valve for causing momentary hydraulic fluid flow in a forward direction during actuation of the forward momentary switch by an operator;

a latching auxiliary control switch system including a latch switch coupled to the electrically actuated auxiliary control valve for causing continuous fluid flow in a forward direction in response to operator actuation of the latch switch;

an auxiliary enable switch having ON and OFF positions; and an auxiliary mode control circuit coupled to an auxiliary enable switch, an auxiliary mode control switch, the momentary auxiliary control switch system, the latching auxiliary control switch system and the electrically actuated auxiliary control valve, for operating in a disable mode, wherein the momentary switch system and latching switch system are disabled when the enable switch is actuated from the OFF position to the ON position, for operating in a momentary mode in response to operator actuation of the mode control switch when the enable switch is in the ON position thereby enabling momentary switch control over the electrically actuated control valve and disabling latch switch control over the electrical actuated control valve, and for operating in a latch mode in response to a next subsequent operator actuation of the mode control switch when the enable switch is in the ON position thereby enabling latch switch control over the electrically actuated auxiliary valve.

2. The skid steer loader of claim 1 wherein the enable switch includes a key switch.

3. The skid steer loader of claim 1 and an auxiliary mode control mode display coupled to the auxiliary mode control circuit for providing a visual indication of the auxiliary mode operation in the momentary mode and in the latch mode.

4. The skid steer loader of claim 1 wherein the latching auxiliary control switch system includes a momentary contact switch.

5. The skid steer loader of claim 1 and further including:

a rear attachment mount for removably mounting a rearward attachment having a rearward auxiliary hydraulic motor to a rear portion of the loader;

rear auxiliary fluid fittings for coupling hydraulic fluid to the rearward auxiliary hydraulic motor of a rear mounted attachment;

an electrically controlled diverter valve coupled in the hydraulic circuit between the auxiliary control valve and the first fluid fittings and between the auxiliary control valve in the rear fluid fittings, for selective routing of hydraulic fluid between the auxiliary control valve and one of the first and rear auxiliary fluid fittings in response to an electrical auxiliary select signal;

a rear momentary auxiliary control switch system including a forward momentary switch coupled to the electrically actuated auxiliary control valve, for causing hydraulic fluid flow in a forward direction to the rear auxiliary fluid fittings when actuated by an operator; and wherein the auxiliary mode control circuit disables control of the forward momentary switch of the rear momentary auxiliary control switch system over the electrically actuated control valve when operating in the disable mode and enables control of the forward momentary switch of the rear momentary auxiliary control switch system over the electrically actuated control valve when operating in the momentary mode.

6. The skid steer loader of claim 5 wherein the rear momentary auxiliary control switch system further includes a reverse momentary switch coupled to the electrically actuated auxiliary control valve for causing momentary hydraulic fluid flow in a reverse direction during actuation of the reverse momentary switch by an operator.

7. The skid steer loader of claim 5 and further including means to discontinue continuous fluid flow in a forward direction when the latch switch has been actuated and the forward momentary switch of the rear momentary auxiliary control switch system is actuated.

8. The skid steer loader of claim 1 and further including:

a rear attachment mount for removably mounting a rearward attachment having a rearward auxiliary hydraulic motor to a rear portion of a loader;

rear auxiliary fluid fittings for coupling hydraulic fluid to the rearward auxiliary hydraulic motor of the rear mounted attachment;

a second electrically actuated auxiliary control valve coupled in a hydraulic circuit between the hydraulic pump and the rear auxiliary fluid fittings for controlling hydraulic fluid flow in response to electrical auxiliary select signals;

a rear momentary auxiliary control switch system including a forward momentary switch coupled to the second electrically actuated auxiliary control valve for causing hydraulic fluid flow in a forward direction to the rear auxiliary fluid fittings when actuated by an operator; and wherein the auxiliary mode control circuit disables control of the forward momentary switch of the rear momentary auxiliary control switch system over the electrically actuated control valve when operating in the disable mode and enables control of the forward momentary switch of the rear momentary auxiliary control witch system over the electrically actuated control valve when operated in the momentary mode.

9. The skid steer loader of claim 8 wherein the rear momentary auxiliary control switch system further includes a reverse momentary switch coupled to the second electrically actuated auxiliary control valve for causing momentary hydraulic fluid flow in a reverse direction during actuation of the reverse momentary switch by an operator.

10. The skid steer loader of claim 1 and further including:

an electrically actuated pressure relief assembly coupled in the hydraulic circuit for causing pressure of the hydraulic fluid in the hydraulic circuit to have one of a plurality of maximum pressures; and wherein the auxiliary mode control circuit is coupled to the electrically actuated pressure relief assembly and causes the pressure relief assembly to operate the hydraulic circuit at a first maximum pressure when in the disable mode, and to operate at a second maximum pressure when in the latch mode.

11. The skid steer loader of claim 1 wherein the momentary auxiliary control switch system further includes a reverse momentary switch coupled to the electrically actuated auxiliary control valve for causing momentary hydraulic fluid flow in a reverse direction during actuation of the reverse momentary switch by an operator.

12. The skid steer loader of claim 1 wherein the auxiliary mode control circuit further includes reset means for causing the circuit to initialize to the disable mode upon actuation of the enable switch.

13. The skid steer loader of claim 12 wherein the auxiliary mode control circuit further includes mode select means for causing the mode control circuit to sequentially switch between the disable mode, the momentary mode, the latch mode and the disable mode in response to sequential operator actuations of the mode control switch.

14. The skid steer loader of claim 13 wherein the mode select means includes:

a switch debounce circuit, its input electrically coupled to the auxiliary mode control switch and its output being electrically coupled to a clock input of a counter;

an output of the counter electrically coupled to a first lead of a coil of a first relay and a second lead of the coil of the first relay being electrically coupled to a power supply;

an input of a contact of the first relay being electrically coupled to the enable switch; and an output of the contact of the first relay being electrically coupled to the momentary auxiliary control switch system and the latching auxiliary control switch system.

15. The skid steer loader of claim 12 wherein the auxiliary mode control circuit further includes voltage regulator means to regulate voltage applied to selected electrical components.

16. The skid steer loader of claim 12 wherein the auxiliary mode control circuit further includes a latching means which receives an input from the latching auxiliary control switch system and supplies a latched output to a electrically actuated auxiliary control valve and the pressure relief assembly.

17. The skid steer loader of claim 15 wherein the latching means includes:

a switch debounce circuit, its input being electrically coupled to the latch switch and its output being electrically coupled to an input of the latch enable flip flop;

an output of the latch enable flip-flow being electrically coupled to a first lead of a coil of a second relay;

a second lead of the coil of the second relay being electrically coupled to a power supply;

an input of a first contact of the second relay and an input of a second contact of the second relay being electrically coupled to the enable switch;

an output of the first contact of the second relay being electrically coupled to a forward solenoid of the auxiliary control valve;

an output of the second contact of the second relay being electrically coupled to the pressure relief assembly; and a reset of the latch enable flip-flop being electrically coupled to an output of the counter of the mode select means to selectively enable the latch enable flip-flop.

18. An electrically controlled auxiliary hydraulic system coupled to an apparatus having a hydraulic pump, an electrically actuated auxiliary control valve and a plurality of auxiliary hydraulic fittings, including front auxiliary fluid fittings and rear auxiliary fluid fittings, the electrically controlled auxiliary hydraulic system including:

an electrically actuated auxiliary control valve coupled in a hydraulic circuit between the hydraulic pump and the front auxiliary fluid fitting for controlling hydraulic fluid flow in response to electric auxiliary control signals;

a momentary auxiliary control switch system including a forward momentary switch coupled to the electrically actuated auxiliary control valve for causing momentary hydraulic fluid flow in a forward direction during actuation of the forward momentary control switch by an operator;

a latching auxiliary control switch system including a latch switch coupled to the electrically actuated auxiliary control valve for causing continuous fluid flow in a forward direction in response to operator actuation of the latch switch;

an auxiliary enable switch having ON and OFF positions; and an auxiliary mode control circuit coupled to the auxiliary enable switch, an auxiliary mode control switch, the momentary auxiliary control switch system, the latching auxiliary control switch system and the electrically actuated auxiliary control valve, for operating in:

a disable mode thereby disabling control over the electrically actuated auxiliary valve by the momentary switch system and latching switch system when the enable switch is actuated from the OFF position to the ON position;

a momentary mode thereby enabling momentary switch control over the electrically actuated control valve and disabling latch switch control over the electrical actuated control valve in response to operator actuation of the mode control switch when the enable switch is in the ON position;

a latch mode thereby enabling latch switch control over the electrically actuated auxiliary valve in response to operator actuation of the mode control switch when the enable switch is in the ON position.

19. The skid steer loader of claim 18 and further including means to discontinue continuous fluid flow in a forward direction when the latch switch has been actuated and the forward momentary switch of the rear momentary auxiliary control switch system is actuated.

20. The electrically controlled auxiliary hydraulic system of claim 19 wherein the auxiliary mode control circuit further includes reset means for causing the circuit to initialize to the disable mode upon actuation of the enable switch.

21. The electrically controlled auxiliary hydraulic system of claim 20 wherein the auxiliary mode control circuit further includes mode select means for causing the mode control circuit to sequentially switch between the disable mode, the momentary mode, the latch mode and the disable mode in response to consecutive operator actuations of the mode control switch.

22. The electrically controlled auxiliary hydraulic system of claim 21 wherein the auxiliary mode control circuit further includes a latching means which receives an input electrical signal from the latching auxiliary control switch system and supplies an output electrical signal to the electrically actuated auxiliary control valve and a pressure relief assembly.

23. The electrically controlled auxiliary hydraulic system of claim 22 wherein the mode select means includes:

a switch debounce circuit, its input electrically coupled to the auxiliary mode control switch and its output electrically coupled to a clock input of a counter;

an output of the counter electrically coupled to a first lead of a coil of a first relay and a second lead of the coil of the first relay electrically coupled to a power supply;

an input of a contact of the first relay electrically coupled to the enable switch; and an output of the first relay electrically coupled to the momentary auxiliary control switch system and the latching auxiliary control switch system.

24. The electrically controlled auxiliary hydraulic system of claim 23 wherein the latching means includes:

a switch debounce circuit, its input electrically coupled to the latch switch and its output electrically coupled to an input of the latch enable flip-flop;

an output of the latch enable flip-flop electrically coupled to a first lead of a coil of a second relay;

a second lead of the coil of the second relay electrically coupled to a power supply;

an input of a first contact of the second relay and an input of a second contact of the second relay electrically coupled to the enable switch;

an output of the first contact of the second relay electrically coupled to a forward solenoid of the auxiliary control valve;

an output of the second contact of the second relay electrically coupled to the pressure relief assembly; and a reset of the latch enable flip-flop electrically coupled to an output of the counter of the mode select means to selectively enable the latch enable flip-flop.

* * * * *

UNITED STATES PATENT AND TRADEMARK OFFICE

CERTIFICATE OF CORRECTION

PATENT NO. : 5,174,115

DATED : December 29, 1992

INVENTOR(S) : SCOTT B. JACOBSON, KENNETH A. BRANDT

It is certified that error appears in the above-identified patent and that said Letters Patent is hereby corrected as shown below:

On the title Page, in the [56] References Cited Section, under U.S. PATENT DOCUMENTS, insert the following:

4,949,805 8/1990 Mather et al.....180/333

Col. 11, line 49, delete "witch", insert "switch"

Col. 12, line 46, delete "the pressure relief assembly", insert "a pressure relief assembly"

Signed and Sealed this

Twenty-sixth Day of October, 1993

*Attest:*

*Attesting Officer*

Bruce Lehman

BRUCE LEHMAN

*Commissioner of Patents and Trademarks*